US007310074B2

(12) United States Patent
Chen

(10) Patent No.: US 7,310,074 B2
(45) Date of Patent: Dec. 18, 2007

(54) SYSTEM FOR CONTROLLING LED DEVICES

(75) Inventor: Chih-Hsiung Chen, Taipei Hsien (TW)

(73) Assignee: Artled Technology Corp., Taipei Hsien (TW)

( * ) Notice: Subject to any disclaimer, the term of this patent is extended or adjusted under 35 U.S.C. 154(b) by 574 days.

(21) Appl. No.: 10/996,828

(22) Filed: Nov. 24, 2004

(65) Prior Publication Data

US 2006/0109204 A1 May 25, 2006

(51) Int. Cl.
*G09G 3/14* (2006.01)

(52) U.S. Cl. ..... 345/46; 345/82

(58) Field of Classification Search ..... 345/30, 345/38, 39–47, 82, 90–98; 315/291; 348/739
See application file for complete search history.

(56) References Cited

U.S. PATENT DOCUMENTS

2002/0145394 A1* 10/2002 Morgan et al. ..... 315/291
2005/0041161 A1* 2/2005 Dowling et al. ..... 348/739
2006/0082331 A1* 4/2006 Ashdown ..... 315/291

* cited by examiner

*Primary Examiner*—Nitin I. Patel
(74) *Attorney, Agent, or Firm*—Alan Kamrath; Kamrath & Associates P.A.

(57) ABSTRACT

A DMX512 signal source distributor and a loader for a plurality of LED controllers can control LED devices such as an LED board. The DMX512 signal source distributor includes a UART, an MCU connecting to a memory, and a DMX512 encoder chip connecting to a memory. The UART is connected with a personal computer and the MCU, and the UART also can provide a wireless transmission function. The DMX512 encoder chip is further connected to several differential drivers. A loader includes a UART, a MCU connecting to a memory, a keyboard, and an LCM. The signal controllers are controlled by the DMX512 signal source distributor and the loader. The LED controllers can be modulized, which not only can work alone, but also can be combined into a complex system.

10 Claims, 10 Drawing Sheets

SYSTEM FOR CONTROLLING LED DEVICES

BACKGROUND OF THE INVENTION

1. Field of the Invention

The invention relates to a system for controlling LED devices, and more particularly to a system comprising a signal source distributor, an optional loader and a plurality of LED controllers which can control the LED devices such as a LED array more efficient.

2. Description of the Related Art

Conventional LED (light emitting diode) controllers for controlling LED devices such as an LED board, are arranged in a juxtaposition manner and generally require switching one by one to change a control mode. A terminal resistor is required for the LED controller to connect with another LED controller in order to ensure an accuracy of control signals. Thereby it is rather inconvenient for the LED controller to connect to several LED controllers simultaneously, let alone to input control data to the LED controller to control the LED device from a distant place. Besides, a conventional DMX512 signal source includes only a DMX512 signal connector to link to an LED controller, which is very inconvenient when desiring to input a great quantity of the control signals simultaneously.

SUMMARY OF THE INVENTION

In view of the above-mentioned drawbacks, it is therefore an objective of the present invention to provide a DMX512 signal source distributor and a loader for a plurality of light emitting diode (LED) controllers to control LED devices such as an LED board, LED lamps or LED products.

It is a further objective to provide a DMX512 signal source distributor and a loader for a plurality of LED controllers that an LED controller includes a DMX512 signal repeater, which is connected to a DMX512 signal receiver of a next class LED controller, so that a terminal resistor for connecting between two LED controllers without losing an accuracy of input signals is not necessary. In addition, the LED controller provides a function to enable/disable channel number setting that can automatically set the channel number or can be set by input data. Thereby the function of enabling/disabling the channel number setting facilitates users to choose the enable function to set the channel number automatically. Further, the LED controllers can control multi-color or singular color LEDs in a DMX 512 controlled mode.

DETAILED DESCRIPTION OF THE INVENTION

Figure 1A:
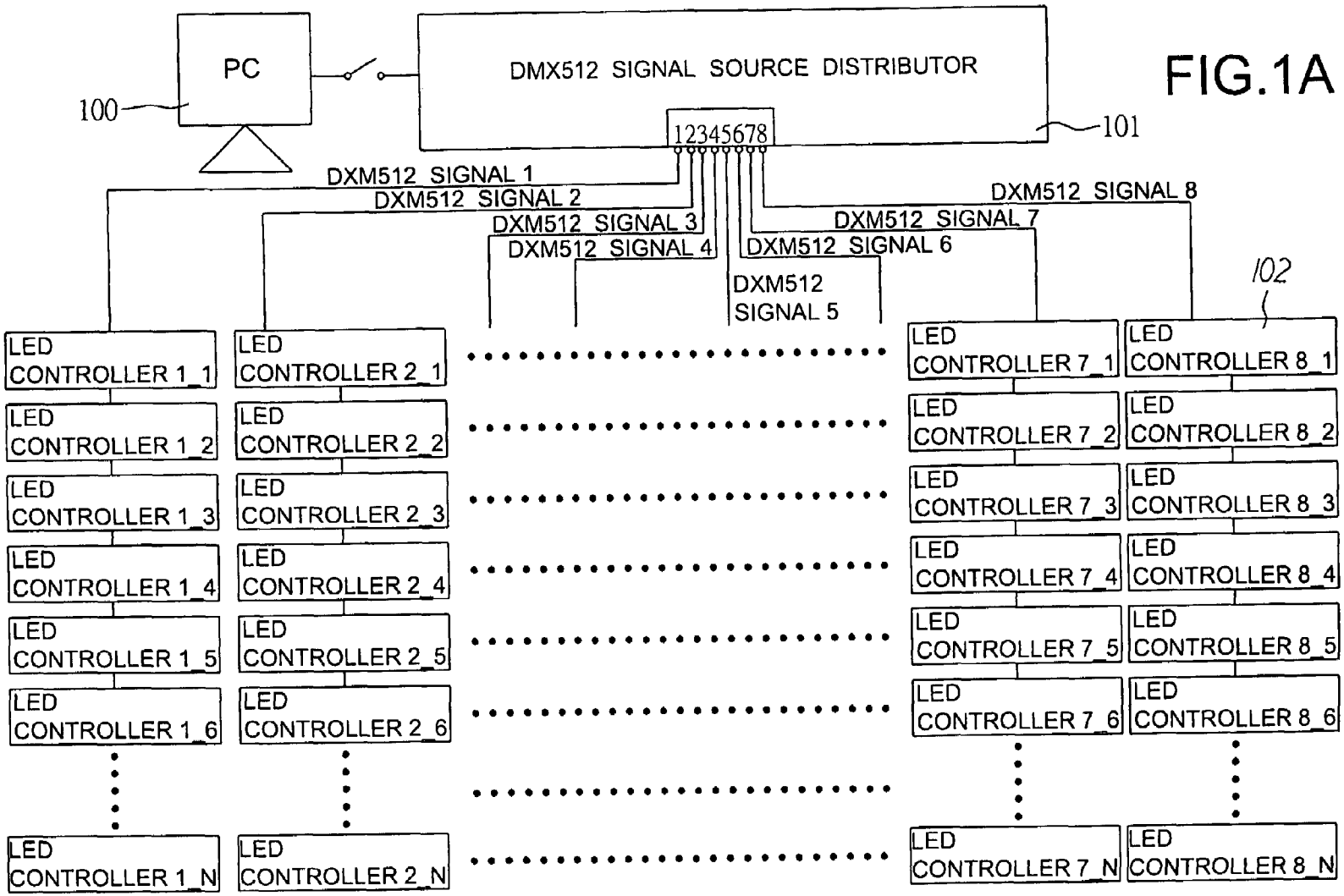
FIG. 1A shows a system block diagram of a DMX512 signal source distributor and a plurality of LED controllers of a practical preferred embodiment of the present invention.

Referring to FIG. 1A, a system block diagram of a practical preferred embodiment of the present invention is shown. The system block diagram of the present invention includes a DMX512 signal source distributor 101 and a plurality of LED (light emitting diode) controllers 102. DMX512 is a well known standard for the connection between lighting controllers, dimmers, strollers, scanners, and so forth. This protocol is developed from a need for standardization and flexibility, and is implemented as a preferred embodiment in the present invention.

Figure 1B:
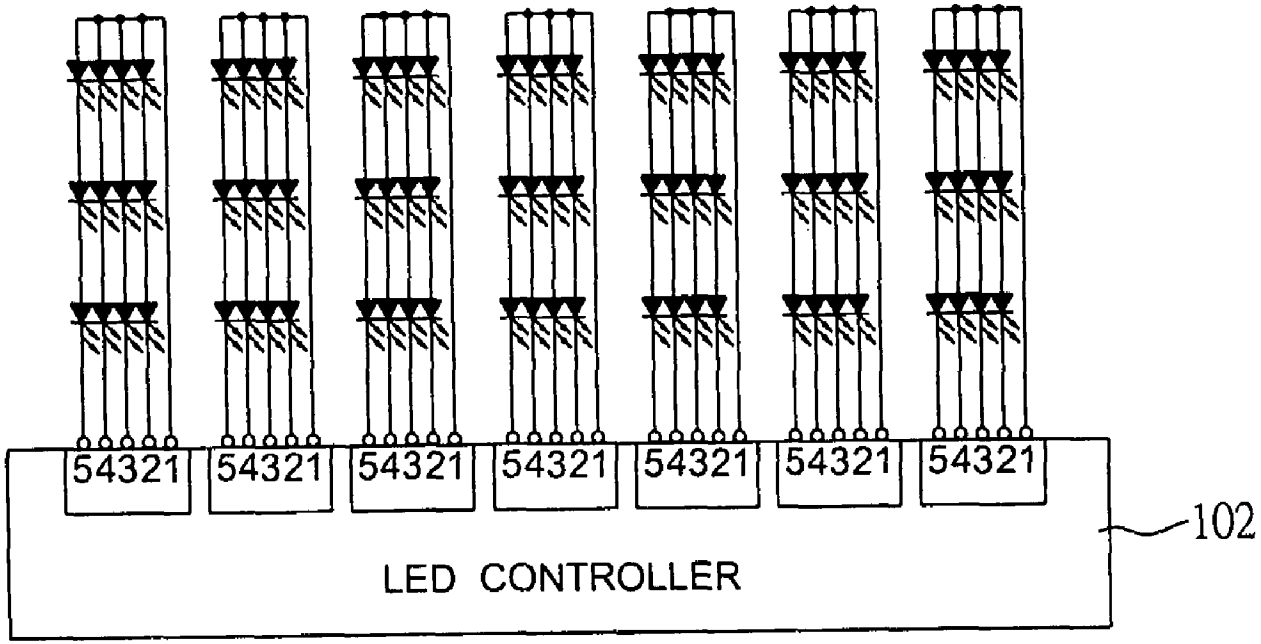
FIG. 1B shows the LED controller in accordance with the present invention controls an LED array.

A personal computer (PC) 100 is optionally linked to the DMX 512 signal source distributor 101. The PC 100 can supply control signals through the DMX512 signal source distributor 101 to the LED controllers 102, so as to control LED devices such as an LED board and so on. The DMX512 signal source distributor 101 can output a plurality of DMX512 signals to the LED controllers 102. Multiple LED controllers 102 are connected in series and can be connected up to N LED controllers 102 for each input line of a DMX512 signal. That is a plurality of LED controllers 102 connected in series can be controlled by a respective DMX512 signal, so that input data can be written at a long distance. With reference to FIG. 1B, each LED controller 102 further controls an LED array as shown.

Figure 2:
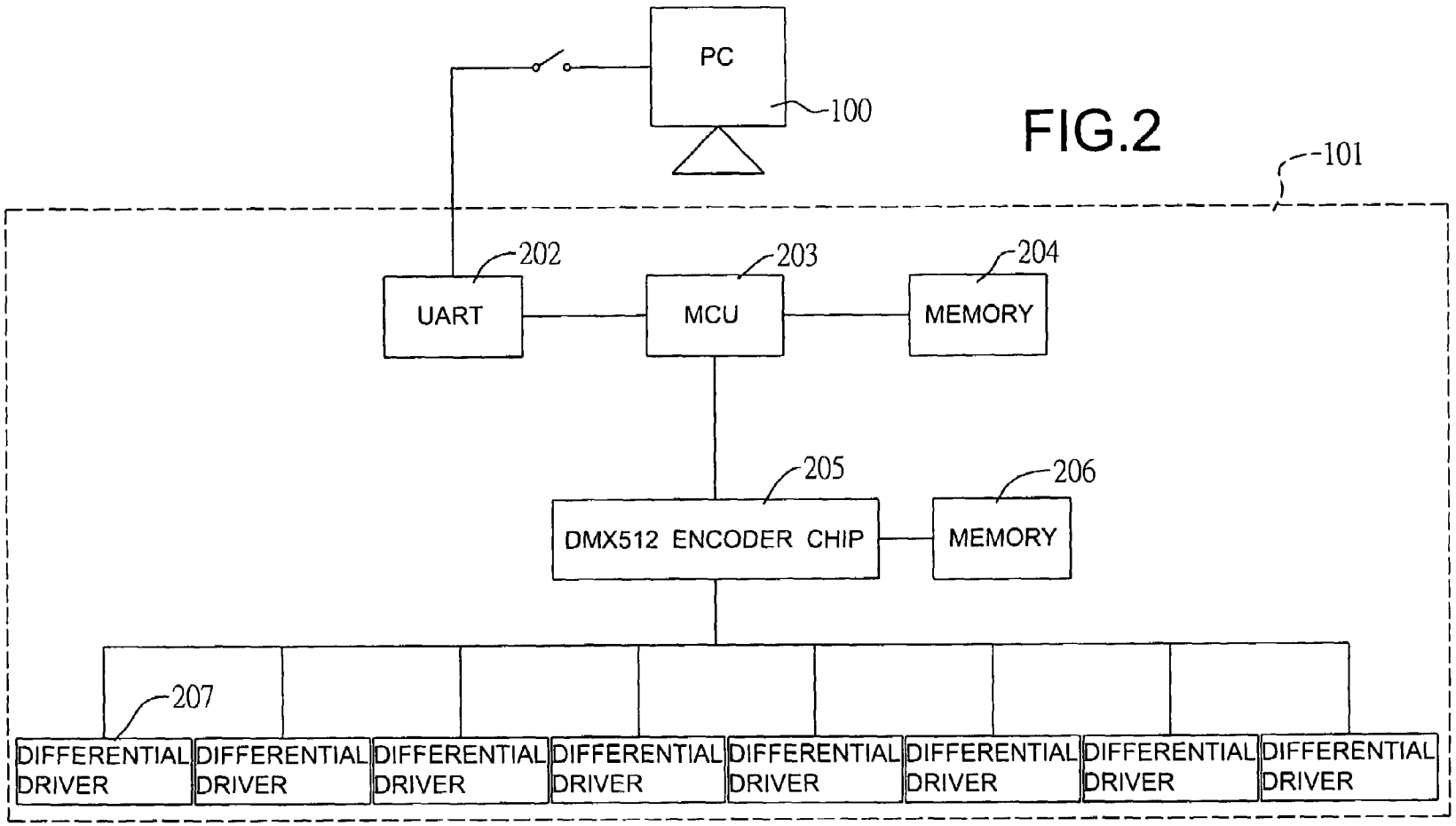
FIG. 2 shows a block diagram of a DMX512 signal source distributor of a practical preferred embodiment of the present invention.

Referring to FIG. 2, a block diagram of the DMX512 signal source distributor 101 is shown. The personal computer (PC) 100 can optionally connect to the DMX512 signal source distributor 101 to output control data to the DMX512 signal source distributor 101. The DMX512 signal source distributor 101 includes a UART (universal asynchronous receiver/transmitter) 202, an MCU (microcontroller unit) 203 connected with a memory 204, a DMX512 encoder chip 205 connected with a memory 206, and a plurality of differential drivers 207. The UART 202 is connected with the PC 100 and the MCU 203, and also can provide a wireless transmission function. The MCU 203 receives signals from the UART 202 and controls the memory 204 and the DMX512 encoder chip 205. The DMX512 encoder chip 205 can read and write the memory 206 and is linked to the differential drivers 207 to transmit the signals to the differential drivers 207.

Figure 3:
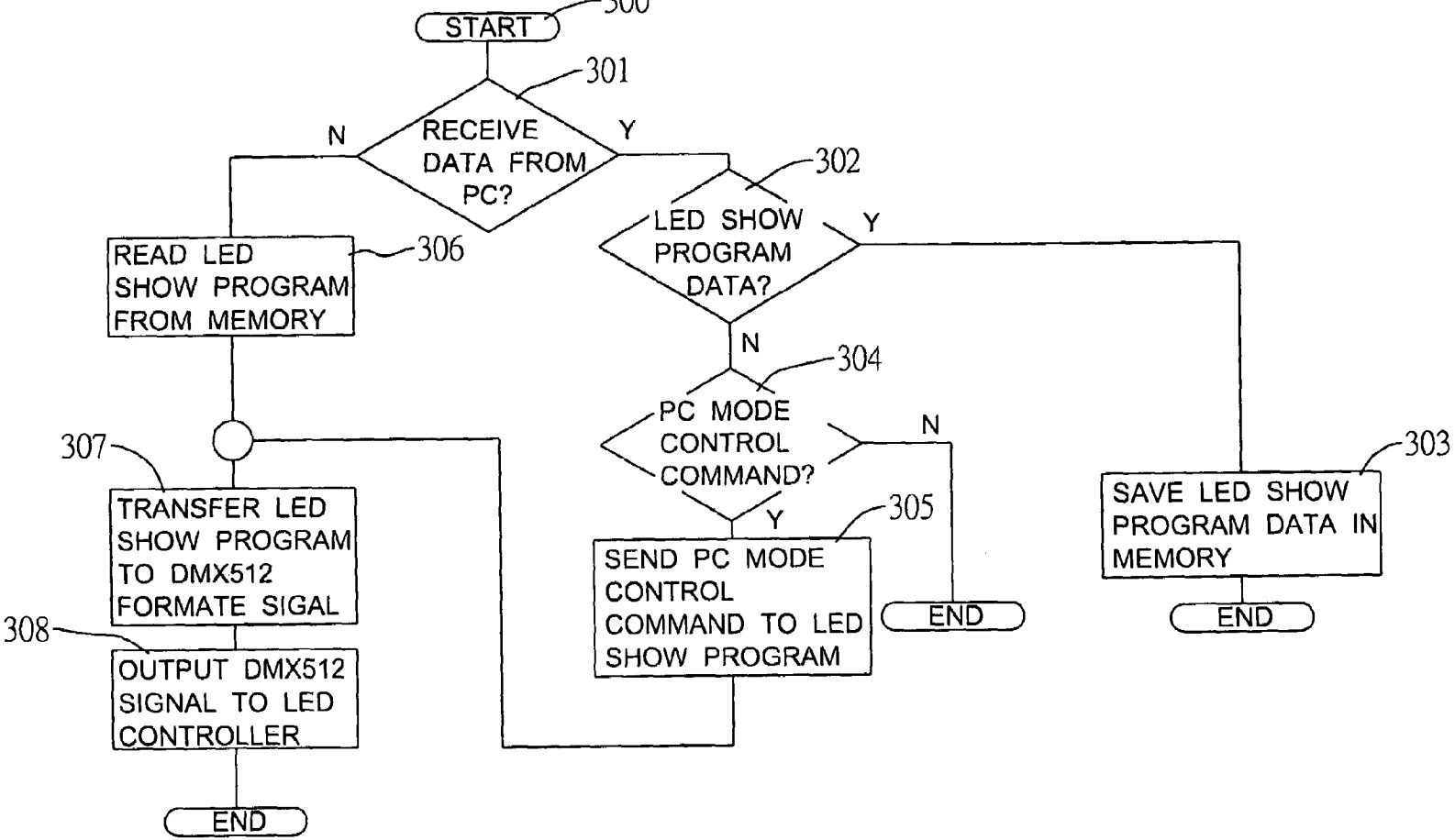
FIG. 3 shows a work flow chart of a DMX512 signal source distributor of a practical preferred embodiment of the present invention.

Referring to FIG. 3, a work flow chart of the DMX512 signal source distributor 101 is shown. Firstly, the DMX512 signal source distributor 101 starts to work as a step 300. In step 301, the DMX512 signal source distributor 101 determines whether data is received from the PC 100 or not.

On one hand, if the DMX512 signal source distributor 101 does not receive the data from the PC 100, the DMX512 signal source distributor 101 then reads a pre-saved LED-show program from its internal memory as shown in step 306. Then the DMX512 signal source distributor 101 transfers the LED-show program to a DMX512 format signal as step 307 and outputs the DMX512 signal to an LED controller 102 as step 308 for controlling LED devices such as an LED array composed of multiple channels.

On the other hand, if the PC 100 is linked to the DMX512 signal source distributor 101, the DMX512 signal source distributor 101 can receive the control data from the PC 100. In step 302, the DMX512 signal source distributor 101 determines whether the received data is an LED-show program data or not. If the received data from PC 100 is the LED-show program data, step 303 of saving the LED-show program data in a memory is executed. That is, the PC 100 is writing the LED-show program data into the DMX512 signal source distributor 101. Therefore, once the PC 101 is removed, the DMX512 signal source distributor 101 itself still can based on the saved LED-show program data control LED devices as foregoing steps 306-308.

On the contrary, if the received data is not the LED-show program data, step 304 of judging whether the data is a PC mode control command or not is executed. If the data is not a PC mode control command, the workflow ends. Otherwise, if the data is a PC mode control command, step 305 of sending the PC mode control command to the LED-show program is executed, and then steps 307 to 308 are sequentially performed. If the PC mode control command is detected in step 304, that means the PC 100 is connected to and directly controls the DMX512 signal source distributor 101 in real time to display desired texts, patterns on the LED devices.

Figure 4:
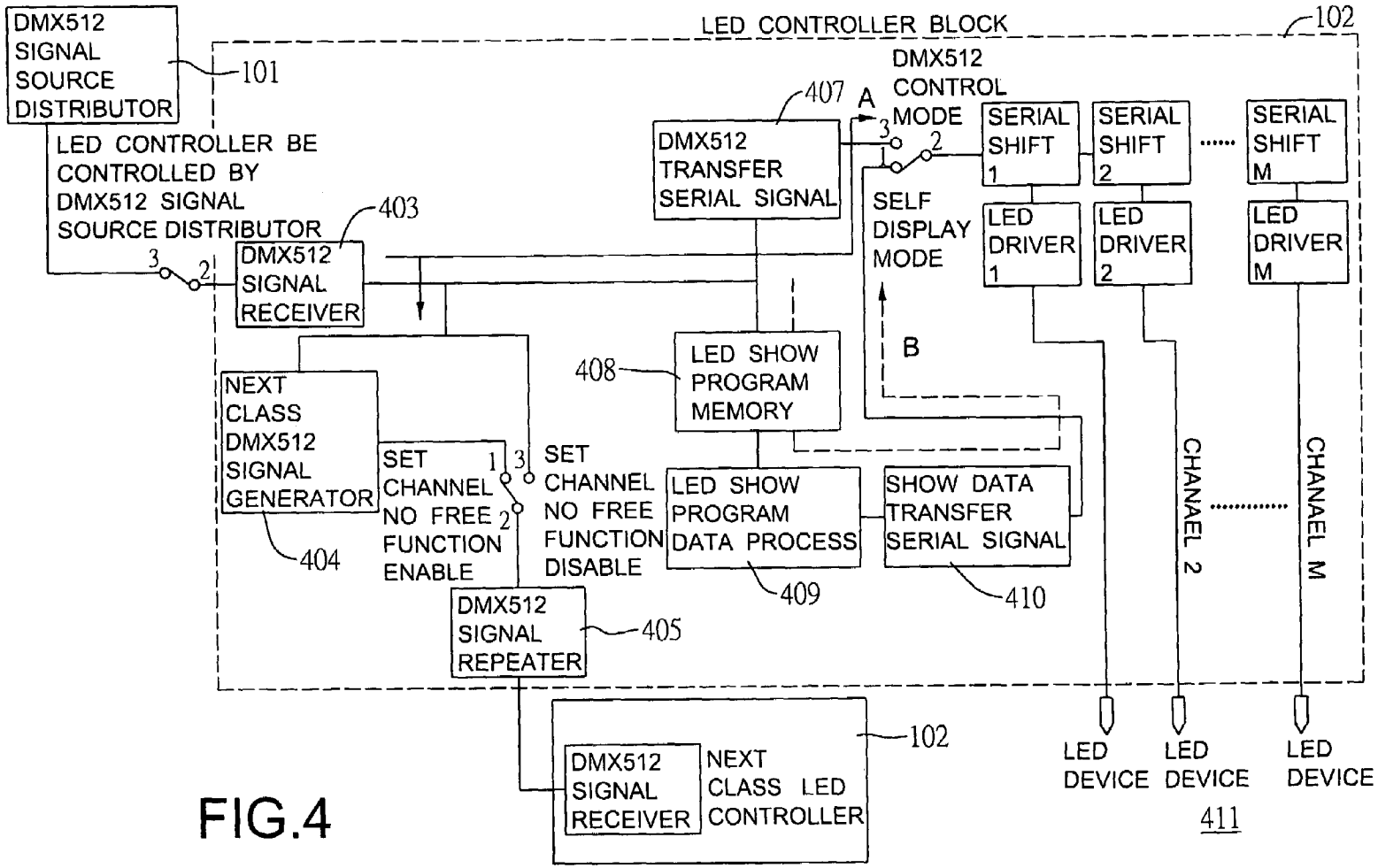
FIG. 4 shows the LED controller being linked to the DMX512 signal source distributor.

Referring to FIG. 4, if the LED controller 102 is linked to the DMX512 signal source distributor 101, based on whether the DMX512 signal is received from the signal source distributor 101, the LED controller 102 can be operated in either a DMX512 control mode (as shown by the path A) or a self display model (as shown by path B). If any DMX512 signal is received, the LED controller 102 can transfer the signal into serial signals (as shown by block 407) and then transmit the serial signal to the serial shifts 1 to M thus driving LED devices 411.

Otherwise, if there is no DMX512 signal, the LED controller 102 itself can read the LED show program from an internal memory (as shown in block 408) and execute data processing processes to drive LED devices 411. Either the DMX512 control mode or the self display mode can be switched to connect to a plurality of serial shifts, 1 to M. Each of the serial shifts is connected to a plurality of LED drivers 1 to M, respectively, and each of the LED drivers is connected to a plurality of LED devices respectively such as an LED board, so as to control the LED devices.

Figure 5A:
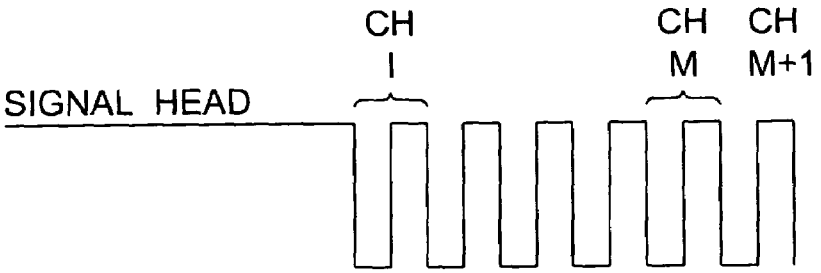
FIGS. 5A-5C show waveforms of DMX512 signals in accordance with the present invention.
Figure 5B:
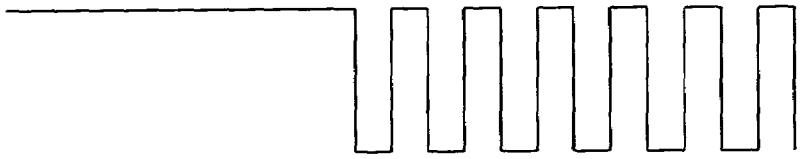

The LED controller 102 includes a DMX512 signal receiver 403 to receive control signals from the DMX512 signal source distributor 101. A function of "channel number free" can be enabled or disabled. If the function is disabled, the received DMX512 signal as shown in FIG. 5A is directly repeated and transmitted to a next class LED controller 102 through a DMX signal repeater 405. It is noted that a complete DMX512 signal is composed of a signal head portion and multiple channel signals. If the function of "channel number free" is disabled, each LED controller 102 must be preset to have a channel number so as to retrieve a corresponding channel signal contained in the DMX512 signal. For example, if an LED controller 102 is designated with a channel number 5, the LED controller 102 only retrieves the signals of channel 5 to channel 5+M contained in the DMX512 signal.

Figure 5C:
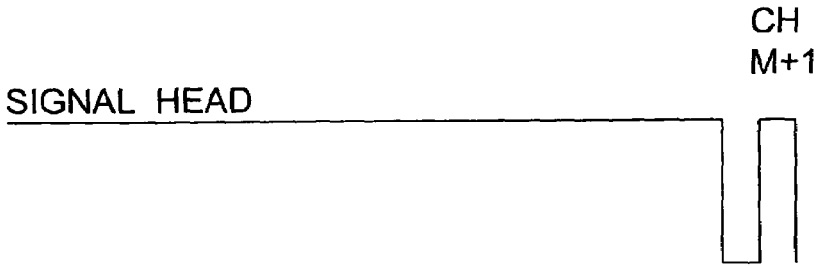

If the function of "channel number free function" is enabled, all LED controllers 102 are just simply designated with channel 1. Therefore, each LED controller 102 can automatically retrieve desired data from the first channel signal adjacent to the signal head. In this embodiment, each LED controller is able to retrieve M channel signals. In this enabled mode, a next class DMX512 signal generator 404 in the LED controller 102 is activated. The signal generator 404 based on a currently received DMX512 signal output from a previous class LED controller 102, for example the signal shown in FIG. 5A, generates a new DMX512 signal as shown in FIG. 5C. It is noted that there are M channel signals are modified to become a new signal head. For a subsequent LED controller 102, since its channel number is 1, the subsequent LED controller 102 can obtain correct channel signals from the channel M+1. For a user who needs to control a great LED array, all the LED controllers 102 can be simply preset with the same channel number 1 without necessary to respectively designate an individual channel number to different LED controllers.

Figure 6:
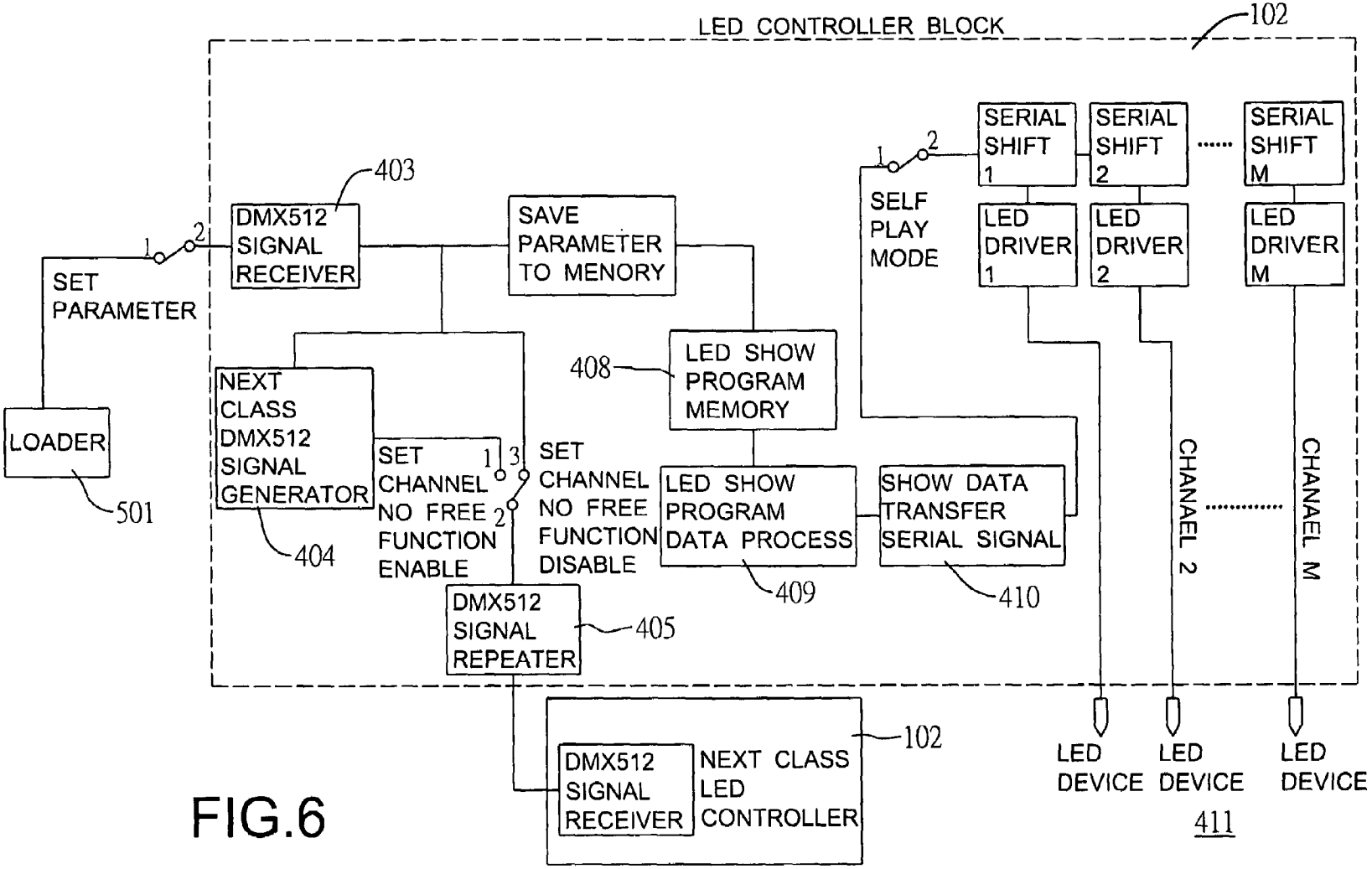
FIG. 6 shows the LED controller being linked to the loader.

With reference to FIG. 6, the LED controller 102 is able to link to an optional loader 501. When the loader 501 is linked to the LED controller 102 for parameters setting, these parameters are stored in a memory of the LED controller 102. Moreover, all subsequent LED controllers 102 connected in series will have the same parameters. Besides the parameters setting, the loader 501 also can output control data to the LED controller 102, whereby the LED controller can control the LED devices 411 to demonstrate the desired text, information or patterns immediately for checking.

Figure 7:
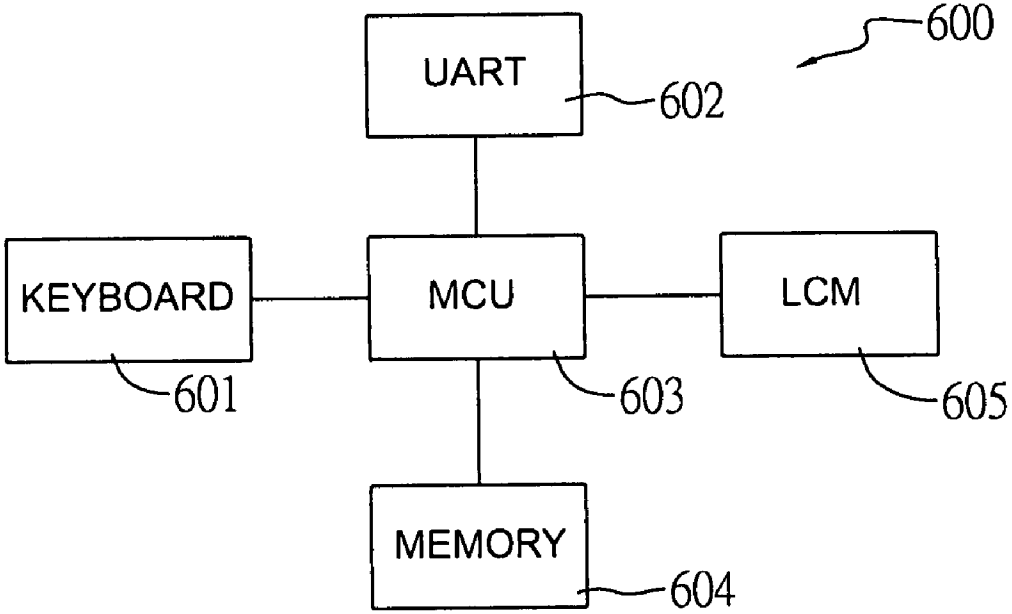
FIG. 7 shows a block diagram of a loader of a practical preferred embodiment of the present invention.

With reference to FIG. 7, a block diagram of the loader 501 is shown. The loader 501 includes a UART (universal asynchronous receiver/transmitter) 602, an MCU (microcontroller unit) 603, a memory 604, a keyboard 601 and an LCM (Liquid Crystal Module) 605. The MCU 603 is connected to the UART 602. The keyboard 601 can input data to the MCU 603, and the LCM 605 can display the input data from the keyboard 601 or display programs that are read from the memory 604. The MCU 603 also can save the input data to the memory 604.

Figure 8:
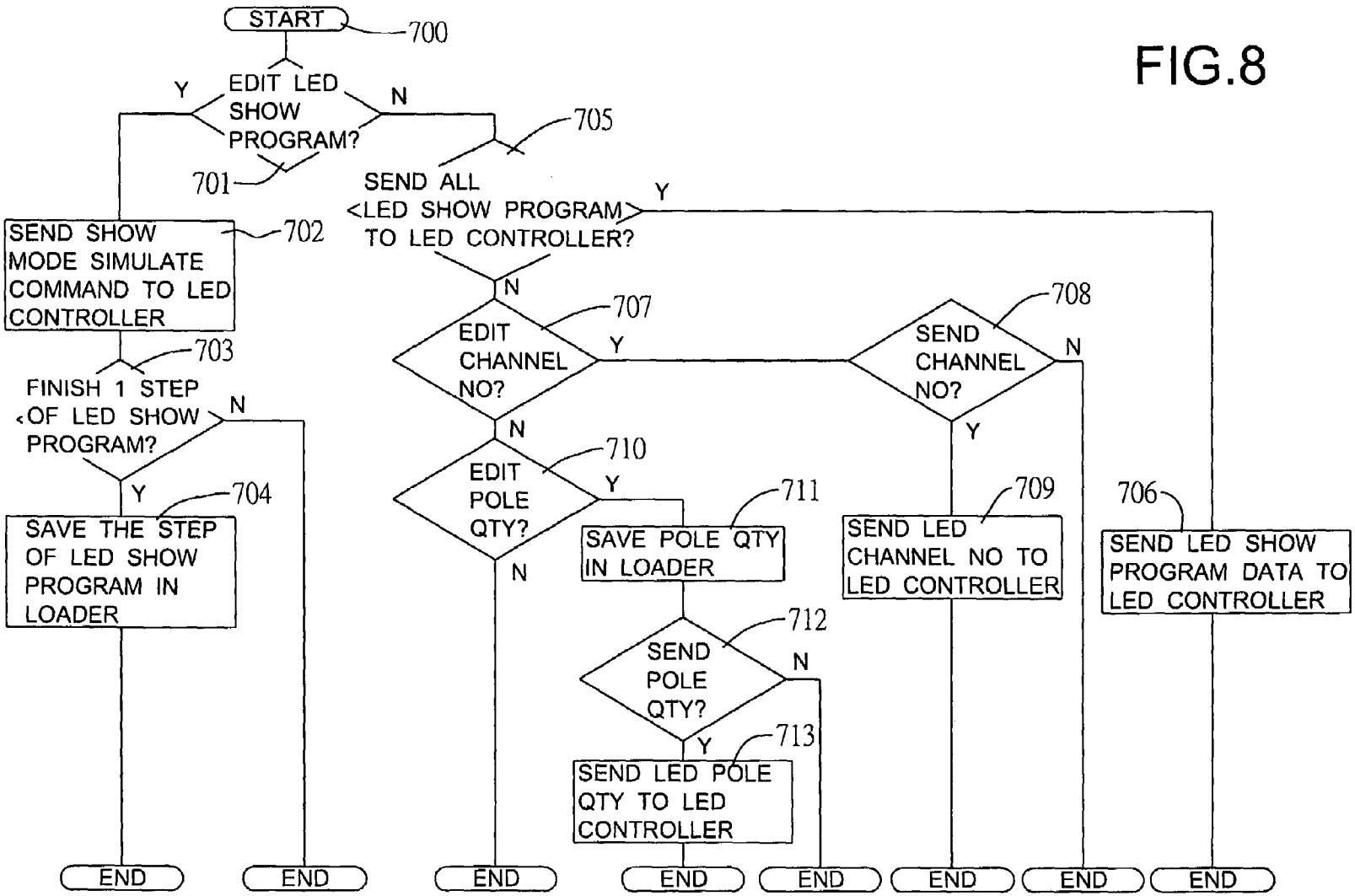
FIG. 8 shows a work flow chart of a loader of a practical preferred embodiment of the present invention.

Referring to FIG. 8, a work flow chart of the loader 501 is shown. Firstly, the loader 501 starts to work as step 700. Step 701 shows whether to edit an LED-show program or not. On one hand, if editing the LED-show program is performed, step 702 of sending show-mode simulate command to an LED controller 102 is executed. Next step 703 of determining whether to finish the LED-show program or not is executed. If a true value is set to step 703, step 704 of saving the LED-show program in the loader 501 is executed.

On the opposite, if a false value is set to step 703, then the workflow ends.

On the other hand, if editing the LED-show program is not performed, step 705 of determining whether to send all LED-show programs to the LED controller 102 is executed. If the result of step 705 is true, step 706 of sending LED-show program data to the LED controller 102 is executed.

On the contrary, if the result of step 705 is false, step 707 of whether to edit channel number or not is executed. If step 707 of editing the channel number is true, step 708 of determining whether to send a channel number or not is executed. If step 708 of sending the channel number is not performed, the workflow ends. Otherwise, step 709 of sending an LED channel number to the LED controller is executed.

On the contrary, if step 707 of whether to edit channel number or not is false, step 710 of determining whether to edit pole quantity or not is executed. If step 710 is false, the workflow ends. Otherwise, if step 710 is true, step 71 of saving the pole quantity to the loader 102 is executed. Then step 712 of determining whether to send pole quantity or not is executed. If step 712 of whether to send pole quantity or not is false, the workflow comes to an end; otherwise if step 712 is true, step 713 of sending an LED pole quantity (pole QTY) to the LED controller 102 is executed, and then the workflow ends. In short, the steps from 707 to 713 are for setting parameters into the LED controller 102.

Figure 9:
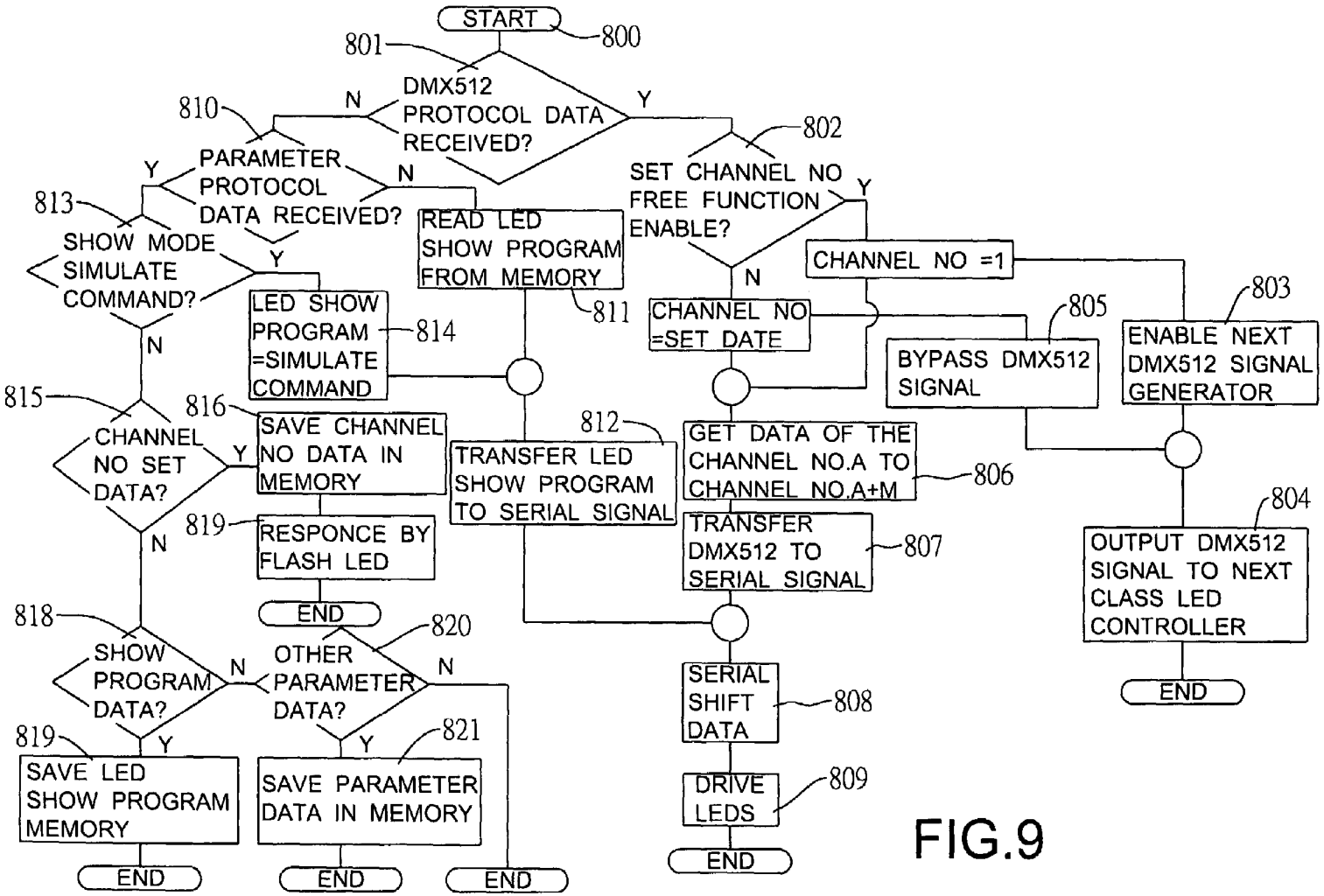
FIG. 9 shows a work flow chart of an LED controller of a practical preferred embodiment of the present invention.

With reference to FIG. 9, a detailed work flow chart of the LED controller 102 is shown. Firstly, the LED controller 102 starts to work as step 800. Step 801 shows that whether DMX512 protocol data is received or not. On one hand, if DMX512 protocol data is received, step 802 of whether to set channel number free to enable or not is executed. If step 802 is true, the channel number is set to become 1 automatically, and then not only is the next DMX512 signal generator enabled as shown in step 803, so as to output the DMX512 signal to a next class LED controller as shown in step 804; but also the LED controller gets data of the channel number as shown in step 806.

On the contrary, if step 802 is false, the channel number is equal to the set data, so that step 806 can get data of the channel number, and also the channel number passes a DMX512 signal as step 805 to output the DMX512 signal to the next class LED controller 102 as shown in step 804. Further, after step 806, step 807 of transferring the DMX512 signal to a serial signal is executed to become a serial shift data of step 808, so as to drive LEDs as shown in step 809. On the other hand, if step 801 is false, step 810 of determining whether parameter protocol data is received or not is executed, wherein the parameter protocol data is inputted by a loader as described above.

If the LED controller does not receive the parameter protocol data from the loader, step 811 of reading an LED-show program from a memory is executed, and then the LED-show program is transferred to a serial signal as shown in step 812, and then step 808 and step 809 are executed in order. On the contrary, if the LED controller 102 receives the parameter protocol data from the loader, step 813 of determining whether the data is a show-mode simulate command or not is executed. If the data is a show-mode simulate command, the LED-show program is equal to the simulate command as in step 814, and then step 812, step 808, step 809 are executed in order. Otherwise, if the data is not a show-mode simulate command, whether the data is a channel number set data or not is determined as shown in step 815. If the data is not the channel number, step 818 of determining whether to show program data or not is executed. If step 818 is true, step 819 of saving the LED-show program data into a memory is executed, and then come to an end. Otherwise, if step 818 is false, step 820 of determining whether the data is other parameter data or not is executed. If the data is other parameter data, step 821 of saving the parameter data into a memory is executed, and then comes to an end. On the contrary, if the data is not other parameter data, the workflow ends. Moreover, following step 815, if the data is the channel number set data, step 816 of saving the channel number data in a memory is executed. Then step 817 of response by a flash LED is executed, and then comes to an end.

Furthermore, the LED controller can be modulized, which not only can work alone after the loader is removed, but also can be combined into a complex system. When the DMX512 signal source distributor 101 is disconnected with the LED controller 102, the auto self-play mode can play the LED-show program. Moreover, the LED controller 102 provides the function of the channel number setting free enabled/disabled. Since the loader 501 can write data to set the parameters to control the LED controller 102, and the LED controllers 102 can be connected in series. The edit port of the auto self-play LED-show program data is the same as the input port of the DMX512 signal, the LED-show program data can be written at a long distance place. The LED controller includes a DMX512 signal repeater for connecting to the next class LED controller, so that a terminal resistor is not necessary. In addition, the LED controller can control multi-color and singular color LED in DMX512 controlled mode.

In conclusion, the present invention provides the DMX512 signal source distributor and the loader for a plurality of the LED controllers. A PC can optionally linked to the distributor to supply control data thus driving the plurality LED controllers. Otherwise, once the PC is removed, the distributor still can based on the stored LED show program to drive the plurality LED controllers. The loader can set desired parameters into each LED controller. Moreover, if the loader is disconnected from the LED controller, the LED controller also can be directly driven based on the control data output from data. It is noted that each LED controller in accordance with the present invention has a function of "channel number free". If the function is enabled, all the LED controllers do not need to be designated with a particular channel number. Therefore, the control of the multiple LED controllers will become more efficient.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A system for controlling LED devices, the system comprising a DMX512 signal source distributor and a plurality of LED controllers, the DMX512 signal source distributor comprising a universal asynchronous receiver/transmitter (UART), an microcontroller unit (MCU) connecting to a memory, and a DMX512 encoder chip connecting to a memory and a plurality of differential drivers;

the LED controller based on DMX512 signals output from the DMX512 signal source distributor to drive the LED devices, wherein the LED controller provides a function of setting a channel number free enabled/disabled to set the channel number automatically or by an input data respectively, if the function is enabled, all the LED controllers are designated with the same channel number.

2. The system as claimed in claim 1, wherein each LED controller comprises a DMX512 signal repeater for connecting to a next class LED controller.

3. The system as claimed in claim 1, each LED controller comprising a next class DMX512 signal generator, wherein if the function of setting the channel number free is enabled, the next class DMX512 signal generator based on a received previous DMX512 signal generates a new DMX512 signal supplied to a next class LED controller.

4. The system as claimed in claim 2, each LED controller comprising a next class DMX512 signal generator, wherein if the function of setting the channel number free is enabled, the next class DMX512 signal generator based on a received previous DMX512 signal generates a new DMX512 signal supplied to a next class LED controller.

5. The system as claimed in claim 1, wherein the LED controller comprises a memory in which an LED show program is stored, when there is no DMX512 signal received from the DMX512 signal source distributor, the LED controller based on the LED show program drives the LED devices.

6. The system as claimed in claim 1, wherein the DMX512 signal source distributor receives control data from a PC.

7. The system as claimed in claim 4, wherein the DMX512 signal source distributor receives control data from a PC.

8. The system as claimed in claim 1, wherein a loader is optionally linked to the LED controller to set parameters and the LED show program in the memory of the LED controller.

9. The system as claimed in claim 7, wherein the parameters comprise the channel number.

10. The system as claimed in claim 8, the loader comprising a UART, an MCU connecting to a memory, a keyboard, and a liquid crystal module.

* * * * *